US011198996B2

(12) United States Patent
Shinomiya et al.

(10) Patent No.: US 11,198,996 B2
(45) Date of Patent: Dec. 14, 2021

(54) FLUSH TOILET

(71) Applicant: TOTO LTD., Kitakyushu (JP)

(72) Inventors: Akira Shinomiya, Kitakyushu (JP); Hiroshi Hashimoto, Kitakyushu (JP); Takashi Ogami, Kitakyushu (JP); Isami Sakaba, Kitakyushu (JP); Haruka Saito, Kitakyushu (JP); Takumi Tsuchitani, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/543,322

(22) Filed: Aug. 16, 2019

(65) Prior Publication Data

US 2020/0063425 A1 Feb. 27, 2020

(30) Foreign Application Priority Data

Aug. 23, 2018 (JP) ..... JP2018-156465

(51) Int. Cl.
*E03D 11/17* (2006.01)

(52) U.S. Cl.
CPC ..... *E03D 11/17* (2013.01)

(58) Field of Classification Search
CPC ..... E03D 11/13; E03D 11/02; E03D 11/08; E03D 11/17; E03D 11/18
See application file for complete search history.

(56) References Cited

U.S. PATENT DOCUMENTS 2,616,094 A * 11/1952 Cramer ..... E03D 11/08 4/428
5,819,326 A 10/1998 Kobayashi et al.
6,108,826 A * 8/2000 Hayashi ..... E03D 11/18 4/252.1

(Continued)

FOREIGN PATENT DOCUMENTS

CN 1145649 A 3/1997
JP 2009-057694 A 3/2009

(Continued)

OTHER PUBLICATIONS

An Office Action mailed by the Japanese Patent Office dated Oct. 1, 2020, which corresponds to Japanese Patent Application No. 2018-156465 and is related to U.S. Appl. No. 16/543,322.

(Continued)

*Primary Examiner* — Janie M Loeppke
(74) *Attorney, Agent, or Firm* — Studebaker & Brackett PC

(57) ABSTRACT

The flush toilet of the present invention includes a bowl which receives waste; and a discharge trap conduit which is connected to a lower portion of the bowl and extends to a discharge opening connected to an inlet of an external discharge pipe and a part of which stores sealing water. The discharge trap conduit includes: an ascending conduit which ascends rearward from the lower portion of the bowl; and a descending conduit that descends from a downstream end of the ascending conduit to the discharge opening. The descending conduit includes a bottom surface on the rear (Continued)

side of the discharge opening and a guiding portion formed on the bottom surface which guides the wastewater flowing horizontally from the bottom surface toward the discharge opening to be directed to either a left or right side of the center of the discharge opening.

7 Claims, 4 Drawing Sheets

(56) References Cited

U.S. PATENT DOCUMENTS

| | | | | |
|---|---|---|---|---|
| 6,292,956 | B1 | 9/2001 | Kayahara | |
| 9,045,890 | B2 * | 6/2015 | Kuru | E03D 11/08 |

FOREIGN PATENT DOCUMENTS

| | | | |
|---|---|---|---|
| JP | 2016-176255 | A | 10/2016 |
| JP | 2017-031772 | A | 2/2017 |
| WO | 95/27833 | A1 | 10/1995 |

OTHER PUBLICATIONS

An Office Action issued by the China National Intellectual Property Administration dated Aug. 27, 2020, which corresponds to Chinese Patent Application No. 201910748726.6 and is related to U.S. Appl. No. 16/543,322 with English language translation.

* cited by examiner

FLUSH TOILET

BACKGROUND OF THE INVENTION

Field of the Invention

The present invention relates to a flush toilet, and more particularly to a flush toilet that includes: a bowl which receives waste; and a discharge flow passage which is connected to a lower portion of this bowl and extends to a discharge opening connected to an inlet of an external discharge pipe and a part of which stores sealing water.

Description of the Related Art

If wastewater discharged from a toilet main body flows into the discharge opening at a time, a discharge trap conduit or discharge pipe is temporarily brought into a full water state and this may cause self-siphonage of drawing water in an upstream side in toward a downstream side. When this self-siphonage occurs, sealing water within the toilet main body is drawn in toward the downstream side and discharged; and this may cause shortage of sealing water.

In order to prevent such a self-siphonage, for example, flush toilets as described in Japanese Patent Laid-Open No. 2016-176255 and Japanese Patent Laid-Open No. 2017-31772 have been proposed. Japanese Patent Laid-Open No. 2016-176255 describes a flush toilet that includes a discharge socket for connecting a discharge opening of a toilet main body and a discharge pipe arranged on a floor surface. The discharge socket of this flush toilet includes a flow-dividing portion at its inflow portion, in which wastewater having flowed in is made to collide with the flow-dividing portion to be divided into upward and downward directions; and the wastewater having been divided into the upward direction is made to swirl in a swirling space. Thus, the maximum instantaneous flow rate of the wastewater to be discharged from the discharge socket to the discharge pipe is reduced and the occurrence of self-siphonage in the discharge pipe is suppressed.

In addition, Japanese Patent Laid-Open No. 2017-31772 describes a flush toilet that includes a discharge trap conduit. A discharge trap conduit of this flush toilet includes a descent conduit. This descent conduit includes: an expansion portion in which the cross-sectional area of a flow passage is successively expanded; a contraction portion provided on the downstream side of the expansion portion, in which the cross-sectional area of the flow passage is contracted; and a water receiving portion between the expansion portion and the contraction portion. In addition, a recessed portion is formed by the expansion portion and the water receiving portion. In this flush toilet, the flow speed of flush water flowing through the descent conduit is delayed by this recessed portion, thereby suppressing the occurrence of self-siphonage.

SUMMARY OF THE INVENTION

As described above, various structures for suppressing the occurrence of self-siphonage have been proposed; however, it is desired to develop a flush toilet in which those structures have been further improved.

The present invention has been made so as to meet such conventional demands, and it is an object of the present invention to provide a flush toilet that can suppress the occurrence of self-siphonage, thereby to surely suppress sealing water from being drawn in toward a downstream side.

In order to achieve the above object, the present invention provides a flush toilet comprising: a bowl for receiving waste; and a discharge flow passage connected to a lower portion of the bowl and extending to a discharge opening connected to an inlet of an external discharge pipe, a part of the discharge flow passage storing sealing water; wherein the discharge flow passage includes an ascending flow passage ascending rearward from the lower portion of the bowl and a descending flow passage descending from a downstream end of the ascending flow passage to the discharge opening; and the descending flow passage of the discharge flow passage includes a bottom surface on a rear side of the discharge opening, and a guiding portion formed on the bottom surface, the guiding portion being configured to guide the wastewater flowing horizontally from the bottom surface toward the discharge opening to be directed to either a left or right side of the center of the discharge opening.

In the present invention thus configured, the guiding portion is formed on the bottom surface of the descending flow passage. The guiding portion guides the wastewater flowing horizontally toward the discharge opening to be directed to either a left or right side of the center of the discharge opening. Therefore this guiding portion makes the wastewater, which flows into the discharge opening, easily flow in while deviating from the center of the discharge opening. Accordingly, self-siphonage, otherwise occurring due to wastewater sealing the discharge flow passage (such as a discharge trap) and a part of the discharge pipe, can be suppressed from occurring within the discharge flow passage and discharge pipe. Thus, the present invention can suppress sealing water in the flush toilet from being drawn in toward the downstream side.

In the present invention, preferably, the guiding portion has an inclined surface inclined obliquely downward toward either a left or right side of the bottom surface of the descending flow passage.

According to the present invention thus configured, the inclined surface of the guiding portion guides wastewater to either the left or right side before its flow into the discharge opening, thereby allowing the wastewater, which flows into the discharge opening, to flow in while deviating from the center of the discharge opening. Thus, self-siphonage, otherwise occurring due to wastewater sealing the discharge flow passage and a part of the discharge pipe, can be suppressed from occurring within the discharge flow passage and discharge pipe.

In the present invention, preferably, the inclined surface of the guiding portion is inclined obliquely downward to either the left or right side and forward.

According to the present invention thus configured, the inclined surface of the guiding portion is inclined obliquely downward to either the left or right side and forward; and therefore, makes the flow of wastewater deviate sideward before its flow into the discharge opening, thereby allowing the wastewater to more surely flow in while deviating from the center of the discharge opening. Thus, self-siphonage, otherwise occurring due to wastewater sealing the discharge flow passage and a part of the discharge pipe, can be suppressed from occurring within the discharge flow passage and discharge pipe.

In the present invention, preferably, the guiding portion has an upper surface that is provided at an upper part of the inclined surface and has a smaller inclination angle than that of the inclined surface.

According to the present invention thus configured, the wastewater having flowed into the downstream flow passage collides with the upper surface once, thereby allowing the flow of the wastewater to be disturbed. This can suppress the flow of the wastewater from being locally concentrated. Accordingly, the present invention can suppress self-siphonage, otherwise occurring due to sealing the discharge flow passage and a part of the discharge pipe, from occurring within the discharge flow passage and discharge pipe.

The present invention provides a flush toilet comprising: a bowl for receiving waste; and a discharge flow passage connected to a lower portion of the bowl and extending to a discharge opening connected to an inlet of an external discharge pipe, a part of the discharge flow passage storing sealing water; wherein the discharge flow passage includes an ascending flow passage ascending rearward from the lower portion of the bowl and a descending flow passage descending from a downstream end of this ascending flow passage to the discharge opening; and the descending flow passage of the discharge flow passage includes an inclined surface configured to be inclined either leftward or rightward in an upstream area extending continuously from a bottom surface of a top portion of the ascending flow passage.

In the present invention thus configured, the inclined surface inclined either leftward or rightward is formed in the upstream area, which extends continuously from the bottom surface of the top portion of the ascending flow passage, of the descending flow passage of the discharge flow passage. This inclined surface makes wastewater, which flows into the discharge opening, easily flow in while deviating from the center of the discharge opening. Accordingly, self-siphonage, otherwise occurring due to wastewater sealing the discharge flow passage and a part of the discharge pipe, can be suppressed from occurring within the discharge flow passage and discharge pipe. Thus, the present invention can suppress sealing water in the flush toilet from being drawn in toward the downstream side.

The present invention provides a flush toilet comprising: a bowl for receiving waste; and a discharge flow passage connected to a lower portion of the bowl and extending to a discharge opening connected to an inlet of an external discharge pipe, a part of the discharge flow passage storing sealing water; wherein the discharge flow passage includes an ascending flow passage ascending rearward from the lower portion of the bowl, a descending flow passage descending from a downstream end of this ascending flow passage to the discharge opening, and a discharge socket mounted at a lower end of the descending flow passage; and the discharge socket of the discharge flow passage includes a bottom surface on a rear side of the discharge opening and a guiding portion formed on the bottom portion, the guiding portion being configured to guide the wastewater flowing horizontally from the bottom surface toward the discharge opening to be directed to either a left or right side of the center of the discharge opening.

In the present invention thus configured, the guiding portion is formed on the bottom surface of the discharge socket of the discharge flow passage. The guiding portion guides the wastewater flowing horizontally toward the discharge opening to be directed to either a left or right side of the center of the discharge opening; and therefore, this guiding portion makes the wastewater, which flows into the discharge opening, easily flow in while deviating from the center of the discharge opening. Accordingly, self-siphonage, otherwise occurring due to wastewater sealing the discharge flow passage and a part of the discharge pipe, can be suppressed from occurring within the discharge flow passage and discharge pipe. Thus, the present invention can suppress sealing water in the flush toilet from being drawn in toward the downstream side.

Advantageous Effects of Invention

The flush toilet of the present invention can suppress the occurrence of self-siphonage, thereby being able to surely suppress sealing water from being drawn in toward a downstream side.

DETAILED DESCRIPTION OF THE PREFERRED EMBODIMENTS

First, a basic structure of a flush toilet according to one embodiment of the present invention will be described with reference to FIG. 1 and FIG. 2.

Figure 1:
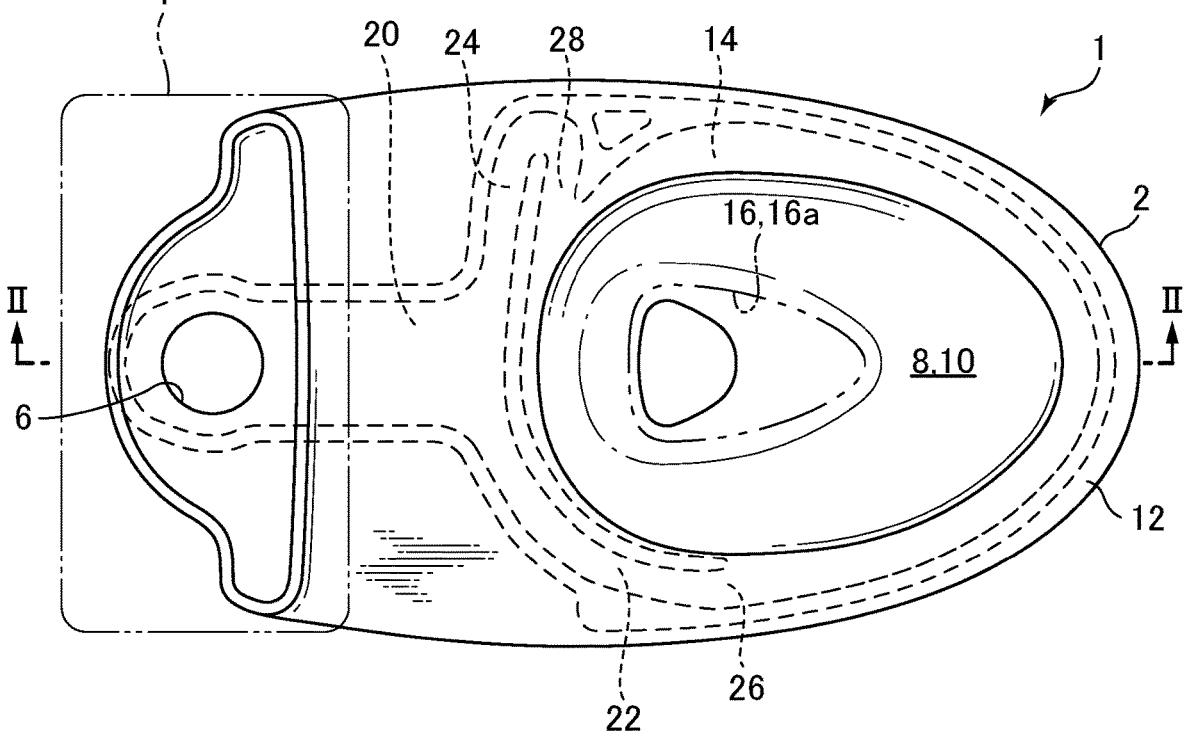
FIG. 1 is a plan view of a flush toilet according to one embodiment of the present invention.
Figure 2:
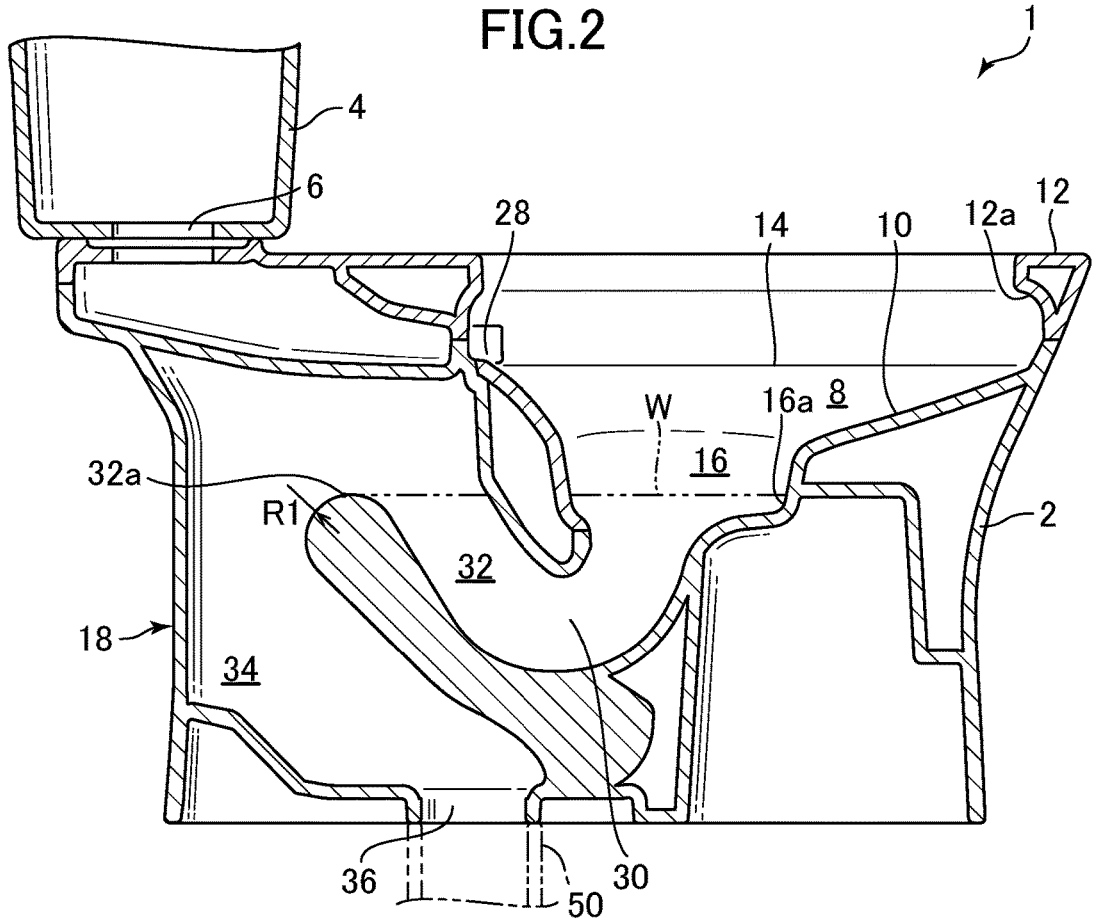
FIG. 2 is a longitudinal sectional view of the flush toilet when viewed along the line II-II in FIG. 1.

As shown in FIG. 1 and FIG. 2, a flush toilet 1 according to one embodiment of the present invention includes a toilet main body 2 and a storage tank 4 that stores flush water supplied to the toilet main body 2. The toilet main body 2 is entirely made of ceramic. Alternatively, the flush toilet 1 may use other water supply sources (running water, etc.) instead of the storage tank 4.

The storage tank 4 stores approximately 3.6 liters to approximately 4.8 liters of flush water and has a tank discharge opening 6 on its lower surface. When a user operates a switch (not illustrated), a discharge valve (not illustrated) is brought into an open state, and flush water within the storage tank 4 is supplied from the tank discharge opening 6 of the storage tank 4 to the toilet main body 2.

The toilet main body 2 has a bowl 8 on its front side, and the bowl 8 includes: a bowl-shaped waste receiving surface 10; a rim 12 that is formed on an upper rim of this waste receiving surface 10; and a shelf portion 14 that is formed between this waste receiving surface 10 and rim 12. On the rim 12, an inner circumferential surface 12*a*, which is overhanging toward an inner side, is formed.

The bowl 8 in the toilet main body 2 further includes a recessed portion 16 that is formed at a lower part of the waste receiving surface 10. This recessed portion 16 is formed by a vertical wall portion 16*a* that extends in a substantially vertical direction and is substantially triangle-shaped in a plan view.

On a lower side of the recessed portion 16 of the bowl 8 of the toilet main body 2, a discharge trap conduit 18 that is a discharge flow passage for discharging waste together with flush water is formed.

The flush toilet 1 according to the embodiment is a "flush-type toilet" that discharges waste by a water-flow action due to the fall of flush water within the bowl 8.

On the rear side of the toilet main body 2, a common rim water conduit 20, which extends in the front-rear direction, extends from its rear to its front; and the rear side of it is connected to the tank discharge opening 6 of the storage tank 4 described above, where flush water flows in from the storage tank 4. A front side that is a downstream end of the common rim water conduit 20 branches into a first rim water conduit 22 and a second rim water conduit 24.

On the downstream end of the first rim water conduit 22, a first rim spouting port 26 is formed. This first rim conduit 22 leads flush water in the storage tank 4 to the first rim spouting port 26 via the common rim water conduit 20. This first rim spouting port 26 is arranged, as shown in FIG. 2, at a center on a left side of the bowl 8 when the toilet main body 2 is viewed from its front; that is, at a side of the recessed portion 16. Flush water is spouted from the first rim spouting port 26 toward the front side of the bowl 8, to the shelf portion 14.

On the downstream end of the second rim water conduit 24, a second rim spouting port 28 is formed. This second rim conduit 24 leads flush water in the storage tank 4 to the second rim spouting port 28 via the common rim water conduit 20. This second rim spouting port 28 is, as shown in FIG. 2, provided in a rear side which is determined when the bowl 8 is divided into two parts in a front-rear direction; and further, is arranged on a right side of the bowl 8 when the toilet main body 2 is viewed from its front. In addition, flush water is spouted also from the second rim spouting port 28 toward the rear side of the bowl 8, onto the shelf portion 14.

Here, the flush toilet 1 according to the embodiment is configured to spout flush water from the first rim spouting port 26 and second rim spouting port 28 to the bowl 8; and is not provided with a jet water spouting port and does not perform jet spouting.

As shown in FIG. 2, the discharge trap conduit 18 includes an inlet 30; and this inlet 30 communicates with the bowl 8 and recessed portion 16. The discharge trap conduit 18 includes: an ascending conduit 32 that ascends rearward from the inlet 30; and a descending conduit 34 that descends frontward from a downstream end 32*a* of this ascending conduit 32 (that is also a top portion 32*a* of the ascending conduit 32) to a discharge opening 36. The top position (top portion 32*a*) of this discharge trap conduit 18 determines the position of a water sealing surface (water storage surface) W. In addition, to the discharge opening 36 of the descending conduit 34, an inlet of a discharge pipe 50 is connected.

Figure 4:
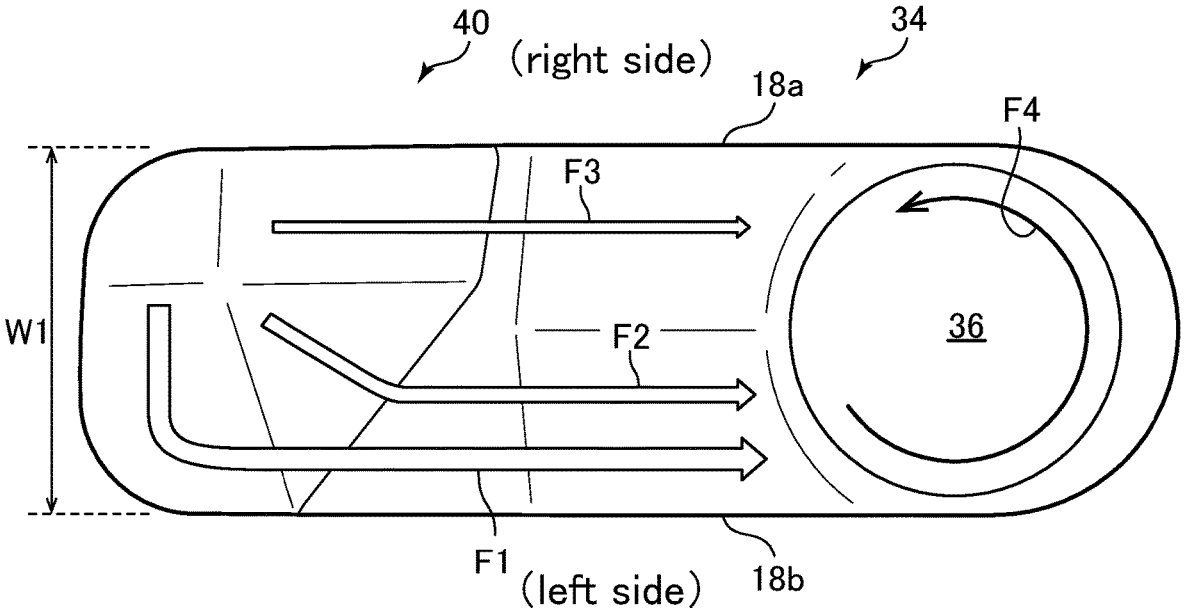
FIG. 4 is a plan view showing the bottom surface of the descending conduit of the flush toilet according to one embodiment of the present invention.

Further, the discharge trap conduit 18 has a wall 18*a* on its right side and a wall 18*b* on its left side when viewed from its front, each of which extends in a perpendicular direction (vertical direction); and a width W1 is constant in the up-down direction (see FIG. 4).

Figure 3:
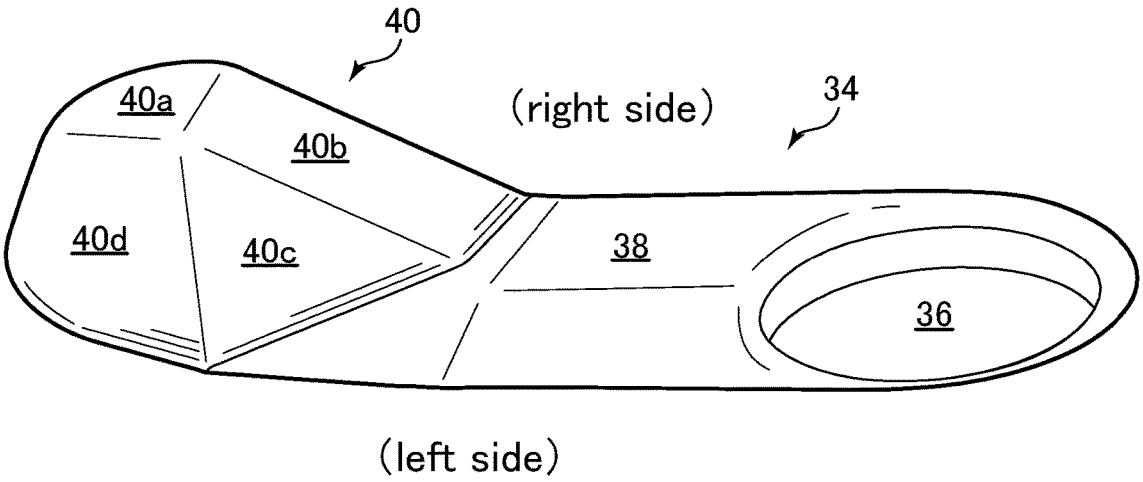
FIG. 3 is a perspective view showing a bottom surface of a descending conduit of the flush toilet according to one embodiment of the present invention.

Next, the descending conduit 34 of the discharge trap conduit 18 will be described in detail with reference to FIG. 3 and FIG. 4. FIG. 3 is a perspective view showing a bottom surface of the descending flow passage 34 of the flush toilet 1 according to the embodiment; and FIG. 4 is a plan view showing the bottom surface of the descending flow passage 34.

As shown in FIG. 3 and FIG. 4, the descending conduit 34 includes a bottom surface 38; this bottom surface 38 forms an area on the rear side (upstream side) of the discharge opening 36.

In the rear side (upstream side) of the bottom surface 38 of the descending conduit 34, a guiding portion 40 is provided. This guiding portion 40 includes four surfaces of an upper surface 40*a*, an inclined surface 40*b*, an inclined surface 40*c*, and an inclined surface 40*d*. All of these four surfaces 40*a*, 40*b*, 40*c*, and 40*d* are flat.

As shown in FIG. 3, the upper surface 40*a* is a flat surface formed at the top position on the right side on the most rear side (most upstream side) and is a little inclined toward the front side (downstream side). Alternatively, this upper surface 40*a* may be a horizontal surface without inclination. The inclined surface 40*b* is a rectangular inclined surface that is inclined downward from the front end of the upper surface 40*a* toward the front. The inclined surface 40*c* is a triangular inclined surface that is inclined obliquely downward from the left side end of the inclined surface 40*b* toward the left side and the front. The inclined surface 40*d* is a rectangular inclined surface that is inclined downward from the left side end of the inclined surface 40*c* toward the left side. Here, the inclination angle of the upper surface 40*a* that is a flat surface is smaller than the inclination angle of any of the other inclined surfaces 40*b*, 40*c*, and 40*d*.

As shown in FIG. 4, in the flush toilet 1 according to the embodiment, the above described guiding portion 40 is formed on the bottom surface 38 of the descending flow passage 34; and therefore, wastewater, which has flowed down from the upstream side of the descending flow passage 34, collides with the four surfaces 40*a*, 40*b*, 40*c*, and 40*d* of the guiding portion 40. The wastewater which has collided with the upper surface 40*a* generates a disturbed flow and after that, it flows along the inclined surfaces 40*b*, 40*c*, and 40*d*.

The wastewater which has collided with the inclined surface 40*b* and the wastewater which has flowed down from the upper surface 40*a* flow on along the inclined surface 40*b* toward the front side (see flow F3 in FIG. 4). The wastewater which has collided with the inclined surface 40*c* and the inclined surface 40*d* and the wastewater which has flowed down from the upper surface 40*a* flow along these surfaces toward the left side (see flows F2 and F1 in FIG. 4). The flow rate of the flows F2 and F1 which go toward the left side is larger than the flow F3 which goes toward the front side. Therefore, the horizontal directional flow of wastewater on the bottom surface 38 of the descending flow passage 34 is turned into a flow directed to the left side of the center of the discharge opening 36; that is, the flow toward the center of the discharge opening 36 is deviated toward the side of a left wall surface 18*b*, turning into a decentered flow. After this, the wastewater flows into the discharge opening 36 while deviating from the center of the discharge opening 36 and generates a swirling flow within the discharge opening 36 (see flow F4 in FIG. 4).

Figure 5:
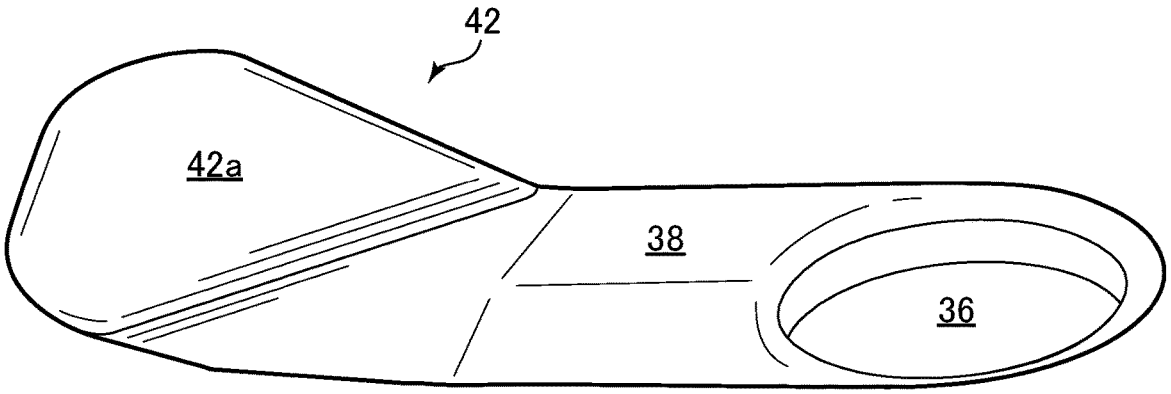
FIG. 5 is a perspective view showing a modified example of the bottom surface of the descending conduit of the flush toilet according to one embodiment of the present invention.

Next, a modified example of the above flush toilet of the embodiment will be described with reference to FIG. 5. FIG. 5 is a perspective view showing a modified example of the bottom surface of the descending conduit of the flush toilet of the embodiment. In the modified example shown in FIG. 5, a guiding portion 42 is formed at the most rear side (the most upstream side) of the bottom surface 38 of the descending conduit 34. This guiding portion 42 includes a triangular flat inclined surface 42*a* that is inclined obliquely downward toward the right side and front side.

Also, in the flush toilet according to this modified example, the wastewater which has flowed down from the upstream side of the descending flow passage 34 collides with the inclined surface 42*a* of the guiding portion 42, as with the above described flush toilet 1. The wastewater which has collided with the inclined surface 42*a* flows along this surface toward the left side. Therefore, the horizontal directional flow of wastewater on the bottom surface 34 of the descending flow passage 34 is turned into a flow directed to the left side of the center of the discharge opening 36; that is, the flow is turned into a flow decentered to the left side. After this, the wastewater flows into the discharge opening 36 while deviating from the center of the discharge opening 36 and generates a swirling flow within the discharge opening 36 (see flow F4 in FIG. 4).

Next, the operation and working effects of the above flush toilet 1 of the embodiment will be described. When a user operates a switch, a discharge valve is brought into an open state, and flush water within the storage tank 4 is supplied from the tank discharge opening 6 into the common rim water conduit 20 of the toilet main body 2. The flush water which has flowed into the common rim water conduit 20 flows toward the front side; and branches and flows into the first rim water conduit 22 and the second rim water conduit 24. The flush water is led to the first rim spouting port 26 by the first rim water conduit 22 and is spouted from the first rim spouting port 26 onto the shelf portion 14. In addition, the flush water is led to the second rim spouting port 28 by the second rim water conduit 24 and is spouted from the second rim spouting port 28 onto the shelf portion 14.

The flush water is spouted to the front side from the first rim spouting port 26 and is also spouted to the rear side from the second rim spouting port 28. This flush water generates a swirling flow of swirling in an identical direction (counterclockwise). With the flush water that is spouted from the first rim spouting port 26, a front side area of the waste receiving surface 10 is mainly washed; and with the flush water that is spouted from the second rim spouting port 28, a rear side area of the waste receiving surface 10 of the bowl 8 is mainly washed.

Next, the flow of wastewater within the discharge trap conduit 18 of the flush toilet 1 according to the embodiment will be described with reference to FIG. 3 to FIG. 5. In the flush toilet 1 according to the embodiment, the guiding portion 40 is formed on the bottom surface 38 on the rear side of the discharge opening 36 in the descending flow passage 34 of the discharge trap conduit 18. This guiding portion 40 makes wastewater, which flows into the discharge opening 36, easily flow in while deviating from the center of the discharge opening 36. Accordingly, self-siphonage, otherwise occurring due to wastewater sealing the discharge trap conduit 18 and a part of discharge pipe, can be suppressed from occurring within the discharge trap conduit 18 and discharge pipe 50. Thus, the flush toilet 1 according to the embodiment can suppress sealing water in the flush toilet 1 from being drawn in toward the downstream side.

The guiding portions 40 and 42 of the flush toilet 1 according to the embodiment include the inclined surfaces 40*c* and 40*d*, and the inclined surface 42*a*, respectively which are inclined obliquely downward toward the left side (or may be toward the right side) of the bottom surface 38 of the descending flow passage 34. These inclined surfaces 40*c*, 40*d*, and 42*a* guide wastewater to the left side before flowing into the discharge opening 36; and thereby allow the wastewater, which flows into the discharge opening 36, to flow in while deviating from the center of the discharge opening 36. Accordingly, self-siphonage, otherwise occurring due to wastewater sealing the discharge trap conduit 18 and a part of the discharge pipe 50, can be suppressed from occurring within the discharge trap conduit 18 and discharge pipe 50.

The inclined surface 40*c* and 40*d* of the guiding portion 40 of the flush toilet 1 according to the embodiment are inclined downward toward the left side; and the inclined surface 40*b* thereof is inclined downward toward the front side. These inclined surfaces 40*b*, 40*c*, and 40*d* allow wastewater to smoothly flow into the discharge opening 36 and allow the wastewater to more surely flow in while deviating from the center of the discharge opening 36. Thus, self-siphonage, otherwise occurring due to wastewater sealing the discharge trap conduit 18 and a part of the discharge pipe 50, can be suppressed from occurring within the discharge trap conduit 18 and discharge pipe 50.

Next, the guiding portion 40 of the flush toilet 1 according to the embodiment includes the upper surface 40*a* that is provided at an upper part than the inclined surfaces 40*b*, 40*c*, and 40*d* and has a smaller inclination angle than the inclined surfaces 40*b*, 40*c*, and 40*d*. Therefore, the wastewater which has flowed into the descending flow passage 34 collides with the upper surface 40*a* once and this allows the flow of the wastewater to be disturbed. Accordingly, the flow of the wastewater can be suppressed from being locally concentrated. Thus, the flush toilet 1 according to the embodiment can suppress self-siphonage, otherwise occurring due to sealing the discharge trap conduit 18 and a part of the discharge pipe 50, from occurring within the discharge trap conduit 18 and discharge pipe 50.

Figure 6:
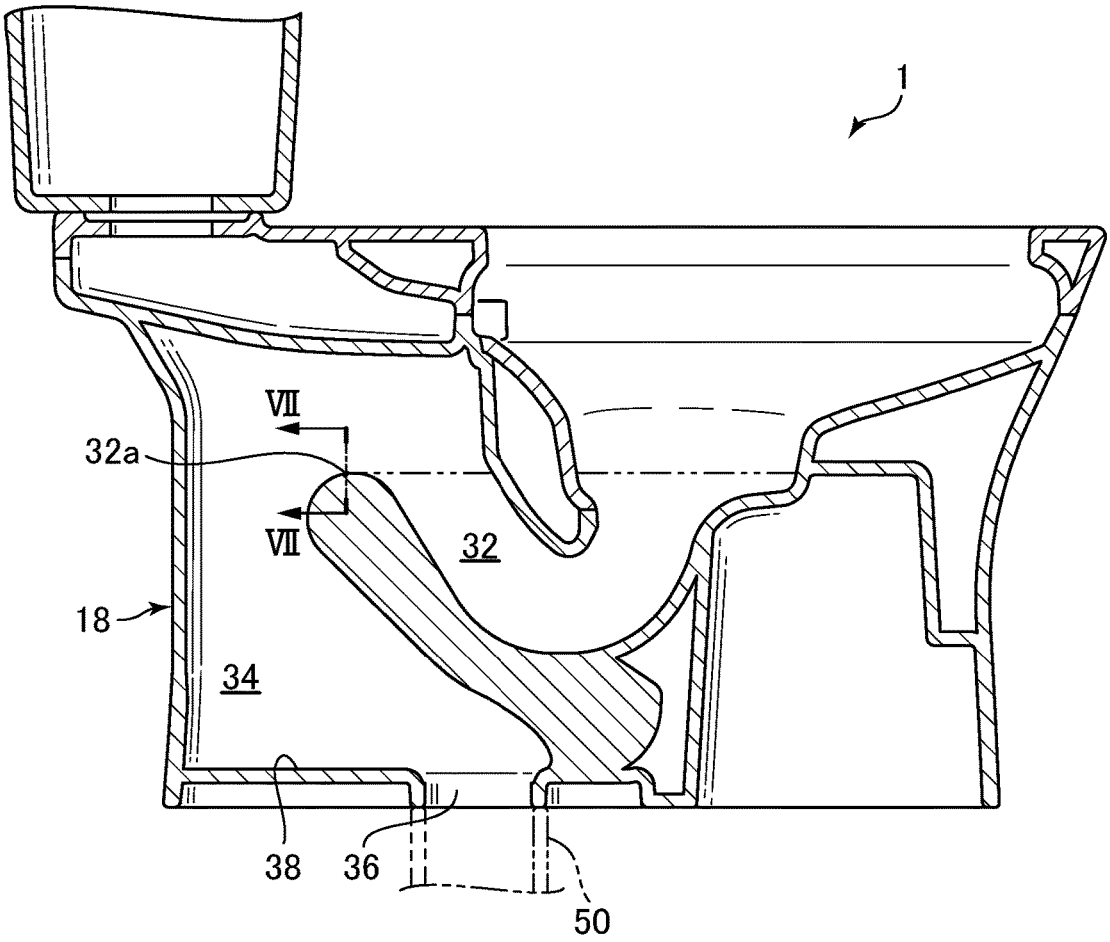
FIG. 6 is a longitudinal sectional view showing a flush toilet according to another embodiment of the present invention.
Figure 7:
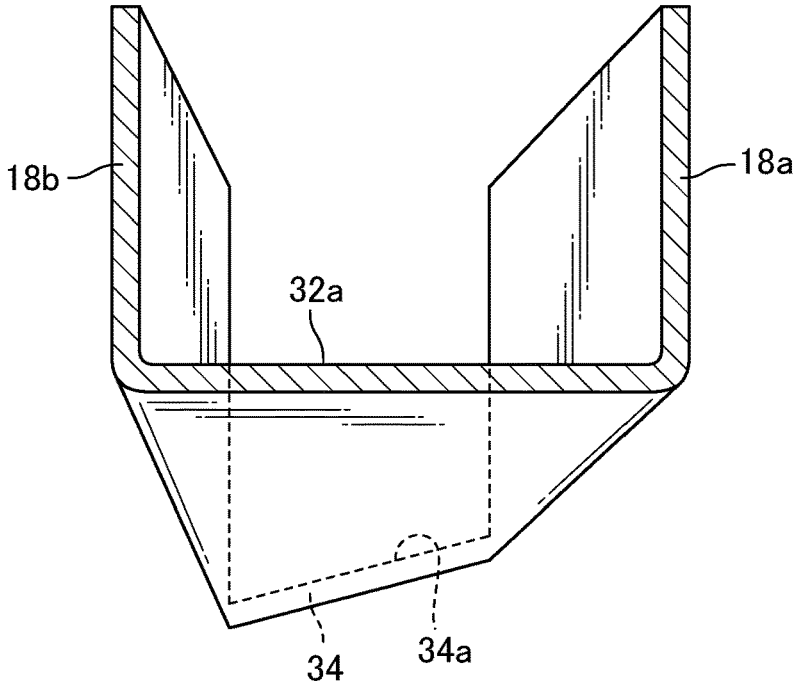
FIG. 7 is a partial projection cross-sectional view (partial center projection cross-sectional view) when viewed along the line VII-VII in FIG. 6.

Next, the flush toilet 1 according to another embodiment of the present invention will be described with reference to FIG. 6 and FIG. 7. In this another embodiment, the guiding portion described above is not provided on the bottom surface 38 of the descending conduit 34 of the discharge trap conduit 18. In the flush toilet 1 in this another embodiment, an inclined surface 34*a* is formed, instead of being provided with the guiding portion, in the descending flow passage 34 of the discharge trap conduit 18. The inclined surface 34*a* is inclined toward the left side (may be inclined toward the right side) in the upstream area that extends continuously from the bottom surface of the top portion 32*a* of the ascending flow passage 32.

In the flush toilet 1 according to this another embodiment, the inclined surface 34*a* that is inclined toward the left side is formed in the upstream area, which extends continuously from the bottom surface of the top portion 32*a* of the ascending flow passage 32, of the descending flow passage 34 of the discharge trap conduit 18. This inclined surface 34*a* makes the wastewater, which flows into the discharge opening 36, easily flow in while deviating from the center of the discharge opening 36. Accordingly, self-siphonage, otherwise occurring due to wastewater sealing the discharge trap conduit 18 and a part of the discharge pipe 50, can be suppressed from occurring within the discharge trap conduit 18 and discharge pipe 50. Thus, the present embodiment can suppress sealing water in the flush toilet 1 from being drawn in toward the downstream side.

Figure 8:
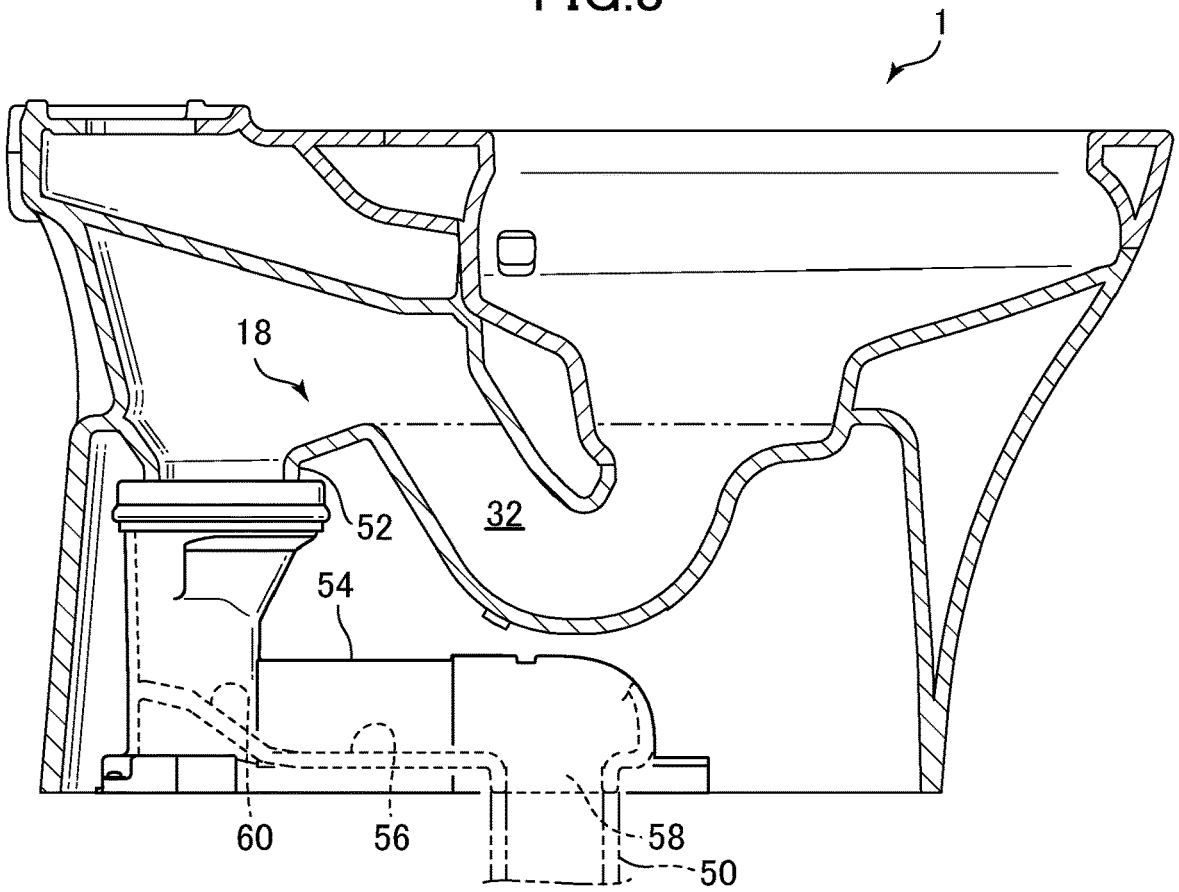
FIG. 8 is a longitudinal sectional view showing a flush toilet according to still another embodiment of the present invention.

Next, the flush toilet 1 according to still another embodiment of the present invention will be described with reference to FIG. 8. In the flush toilet 1 according to this embodiment, a discharge trap conduit 18 includes an ascending conduit 32 and a descending conduit 52. This descending conduit 52 is shorter in length in the up-down direction, as compared with the descending conduit 34 described above. At the lower end of the descending conduit 52, a discharge socket 54, which is a separate component, is mounted. This discharge socket 54 is made of resin. This discharge socket 54 has a flat bottom surface 56 on its rear side; and a discharge opening 58 is formed on its front side.

On the bottom surface 56 of the discharge socket 54, a guiding portion 60 similar to the above-described guiding portion 40 shown in FIG. 3 is formed. This guiding portion 60 also includes an upper surface and three inclined surfaces, similarly to the guiding portion 40.

In the flush toilet 1 according to this still another embodiment, the guiding portion 60 is formed on the bottom surface 56 of the discharge socket 54. The guiding portion guides the horizontally directed flow of wastewater, which flows toward the discharge opening 38, to be directed to the left side (or may be to the right side) of the center of the discharge opening 36. This guiding portion 60 makes the wastewater, which flows into the discharge opening 36, easily flow in while deviating from the center of the discharge opening 36. Accordingly, self-siphonage, otherwise occurring due to wastewater sealing the discharge socket 54 and a part of the discharge pipe 50, can be suppressed from occurring within the discharge socket 54 and discharge pipe 50. Thus, the flush toilet 1 according to the embodiment can suppress sealing water in the flush toilet 1 from being drawn in toward the downstream side.

The guiding portion 60 of the flush toilet 1 according to this still another embodiment may have a structure similar to that of the above-described guiding portion 42 shown in FIG. 5.

In addition, the guiding portion 60 may be configured so that the whole of the bottom surface 56 is inclined either leftward or rightward. Also, in this case, wastewater which flows into the discharge opening 58 can be deviated from the center of the discharge opening 58.

What is claimed is:

1. A flush toilet to discharge waste by a water pressure caused by a head of flush water within a bowl without substantially using a siphon action, comprising:

a bowl for receiving waste; and a discharge flow passage connected to a lower portion of the bowl and extending to a discharge opening connected to an inlet of an external discharge pipe, a part of the discharge flow passage storing sealing water; wherein the discharge flow passage includes an ascending flow passage ascending rearward from the lower portion of the bowl and a descending flow passage descending from a downstream end of the ascending flow passage to the discharge opening; and the descending flow passage of the discharge flow passage includes a bottom surface, the bottom surface being linearly extending from a rear side thereof toward a front side on which the discharge opening is provided, and a guiding portion formed on a rear side of the bottom surface, the guide portion being configured to guide the wastewater flowing horizontally on the bottom surface toward the discharge opening to be directed to either a left or right side of the center of the discharge opening so that the wastewater flows into the discharge opening while deviating from the center of the discharge opening and a self-siphonage can be suppressed from occurring within the discharge flow passage and the external discharge pipe.

2. The flush toilet according to claim 1, wherein, the guiding portion has an inclined surface inclined obliquely downward toward either a left or right side of the bottom surface of the descending flow passage.

3. The flush toilet according to claim 2, wherein the inclined surface of the guiding portion is inclined obliquely downward to either a left or right side and forward.

4. The flush toilet according to claim 2, wherein the guiding portion has an upper surface which is provided at an upper part of the inclined surface and has a smaller inclination angle than that of the inclined surface.

5. A flush toilet to discharge waste by a water pressure caused by a head of flush water within a bowl without substantially using a siphon action, comprising:

a bowl for receiving waste; and a discharge flow passage connected to a lower portion of the bowl and extending to a discharge opening connected to an inlet of an external discharge pipe, a part of the discharge flow passage storing sealing water; wherein the discharge flow passage includes an ascending flow passage ascending rearward from the lower portion of the bowl and a descending flow passage descending from a downstream end of this ascending flow passage to the discharge opening; and the descending flow passage of the discharge flow passage includes an inclined surface configured to be inclined either leftward or rightward in an upstream area extending continuously from a bottom surface of a top portion of the ascending flow passage so that the wastewater flows into the discharge opening while deviating from the center of the discharge opening and a self-siphonage can be suppressed from occurring within the discharge flow passage and the external discharge pipe.

6. A flush toilet to discharge waste by a water pressure caused by a head of flush water within a bowl without substantially using a siphon action, comprising:

a bowl for receiving waste; and a discharge flow passage connected to a lower portion of the bowl and extending to a discharge opening connected to an inlet of an external discharge pipe, a part of the discharge flow passage storing sealing water; wherein the discharge flow passage includes an ascending flow passage ascending rearward from the lower portion of the bowl, a descending flow passage descending from a downstream end of this ascending flow passage to the discharge opening, and a discharge socket mounted at a lower end of the descending flow passage; and the discharge socket of the discharge flow passage includes a bottom surface, the bottom surface being linearly extended from a rear side thereof toward a front side on which the discharge opening is provided, and a guiding portion formed on the rear side of the bottom portion, the guiding portion being configured to guide the wastewater flowing horizontally on the bottom surface toward the discharge opening to be directed to either a left or right side of the center of the discharge opening so that the wastewater flows into the discharge opening while deviating from the center of the discharge opening and a self-siphonage can be suppressed from occurring within the discharge flow passage and the external discharge pipe.

7. The flush toilet according to claim 4, wherein the upper surface of the guiding portion has an inclination angle which is smaller than that of the inclined surface of the guiding portion.

* * * * *